US010711947B2

(12) United States Patent
Paoli et al.

(10) Patent No.: US 10,711,947 B2
(45) Date of Patent: Jul. 14, 2020

(54) DEVICE FOR SUPPLYING PRESSURIZED FLUID

(71) Applicant: L'Air Liquide, Société Anonyme pour l'Etude et l'Exploitation des Procédés Georges Claude, Paris (FR)

(72) Inventors: Herve Paoli, Rueil-Malmaison (FR); Antoine Frenal, Ezanville (FR); Denis Muller, Rueil-Malmaison (FR)

(73) Assignee: L'Air Liquide, Société Anonyme pour l'Etude et l'Exploitation des Procédés Georges Claude, Paris (FR)

( * ) Notice: Subject to any disclaimer, the term of this patent is extended or adjusted under 35 U.S.C. 154(b) by 0 days.

(21) Appl. No.: 16/430,743

(22) Filed: Jun. 4, 2019

(65) Prior Publication Data

US 2019/0368661 A1 Dec. 5, 2019

(30) Foreign Application Priority Data

Jun. 4, 2018 (FR) ..... 18 54815

(51) Int. Cl.
*F17C 13/04* (2006.01)

(52) U.S. Cl.
CPC ..... *F17C 13/04* (2013.01); *F17C 2205/0329* (2013.01); *F17C 2223/036* (2013.01)

(58) Field of Classification Search
CPC ..... F17C 13/04; F17C 2223/036; F17C 2205/0329; F17C 2227/048; F17C 2223/0123; F17C 2205/0394; F17C 2205/0385; F17C 2203/0617; F17C 2201/058; F17C 2201/056
See application file for complete search history.

(56) References Cited

U.S. PATENT DOCUMENTS

| | | | | |
|---|---|---|---|---|
| 6,167,908 | B1 | 1/2001 | Röttger | |
| 2008/0308181 | A1 | 12/2008 | Denis et al. | |
| 2012/0006445 | A1 | 1/2012 | Frenal et al. | |
| 2016/0091144 | A1* | 3/2016 | Wales | F17C 13/04 220/581 |
| 2017/0122497 | A1 | 5/2017 | Bernard | |
| 2018/0038551 | A1 | 2/2018 | Frenal et al. | |
| 2018/0073679 | A1 | 3/2018 | Roberge et al. | |
| 2019/0178399 | A1* | 6/2019 | Takeda | F16K 15/025 |

FOREIGN PATENT DOCUMENTS

| | | |
|---|---|---|
| CA | 2 434 561 | 1/2005 |
| EP | 2 049 829 | 4/2011 |
| FR | 2 792 387 | 10/2000 |
| FR | 2 892 799 | 5/2007 |
| FR | 2 970 313 | 7/2012 |

(Continued)

OTHER PUBLICATIONS

French Search Report and Written Opinion of corresponding FR 1854815, dated Jan. 30, 2019.

*Primary Examiner* — Donnell A Long
(74) *Attorney, Agent, or Firm* — Elwood L. Haynes

(57) ABSTRACT

Device for supplying pressurized fluid, including at least one fluid reservoir provided with an orifice connected to a first valve housing an internal fluid circuit fitted with at least one shut-off member, and a second valve mechanically and detachably connected to the first valve, the second valve having an internal circuit for the transfer of pressurized fluid.

9 Claims, 1 Drawing Sheet

(56) References Cited

FOREIGN PATENT DOCUMENTS

| | | |
|---|---|---|
| FR | 2 979 687 | 3/2013 |
| FR | 3 033 866 | 3/2015 |
| FR | 3 022 972 | 1/2016 |
| WO | WO 2012 004481 | 1/2012 |
| WO | WO 2013 076263 | 5/2013 |
| WO | WO 2016 139404 | 9/2016 |

* cited by examiner

DEVICE FOR SUPPLYING PRESSURIZED FLUID

CROSS REFERENCE TO RELATED APPLICATIONS

This application claims the benefit of priority under 35 U.S.C. § 119 (a) and (b) to French Patent Application No. 1854815, filed Jun. 4, 2018, the entire contents of which are incorporated herein by reference.

BACKGROUND

The invention relates to a device for supplying pressurized fluid.

SUMMARY

The invention relates more particularly to a device for supplying pressurized fluid, notably pressurized gas, comprising at least one pressurized fluid reservoir provided with an orifice connected to a first valve, the first valve housing an internal fluid circuit fitted with at least one shut-off member, the device comprising a second valve mechanically and detachably connected to the first valve, the second valve comprising an internal circuit for the transfer of pressurized fluid when the second valve is in the position in which it is coupled to the first valve, the internal circuit of the second valve being fluidically connected to the internal circuit of the first valve, the second valve comprising a mobile actuating member intended to open the at least one shut-off member of the first valve, the second valve further comprising a control member that is mobile, notably by hand, intended to command the movement of the actuating member and command the opening or non-opening of the shut-off member of the first valve, the device comprising a residual-pressure valve configured to prevent the at least one reservoir from emptying fully below a determined pressure threshold when the at least one shut-off member is open.

The invention relates in particular to a device for distributing fluid, notably pressurized gas, of a modular type. The invention relates notably to the filling of high-pressure gas cylinders (for example at a pressure of between 200 and 700 bar).

Examples of modular fluid distribution devices are illustrated in documents FR2892799A1, FR2979687A1, FR2970313A1, FR3022972A1 or FR303386A1.

In order to prevent the contamination of the cylinders or collections of cylinders, it is known practice to provide residual-pressure valves in the cylinder or in the valve attached thereto, cf. for example FR303386A1.

Such a residual-pressure valve conventionally prevents the cylinder from being completely emptied below a predetermined pressure threshold. That then prevents the ingress of air and moisture notably when the cylinder (the valve thereof) is kept open until the cylinder is completely empty.

This solution, although satisfactory, may sometimes complicate the structure and cost of the cylinder or of its valve attached to it, and may prove complex.

In addition, such a residual-pressure valve housed in the cylinder may be subjected to abrupt emptying operations (withdrawals with Joule-Thompson effect) and rapid filling operations. Thus, such a valve may be subjected to extreme conditions with fluid passing in both directions.

It is an objective of the present invention to propose a fluid supply device that has a simple and compact structure, good ergonomics of use and good safety with regard to the possible contamination of the inside of the reservoir.

One objective of the present invention is to mitigate all or some of the above-mentioned drawbacks of the prior art.

To this end, the device according to the invention, in other respects in accordance with the generic definition thereof given in the above preamble, is essentially characterized in that the residual-pressure valve is situated inside the second valve.

Moreover, some embodiments of the invention may include one or more of the following features:

- the internal fluid transfer circuit of the second valve comprises an upstream end intended to be connected to a downstream end of the internal circuit of the first valve and at least a first downstream end opening onto an outlet coupling, the outlet coupling being intended to be fluidically connected to a receiver of the gas withdrawn from the reservoir, the residual-pressure valve being situated in the internal fluid transfer circuit of the second valve between the upstream end and the downstream end,
- the residual-pressure valve comprises a mobile shut-off member urged by a return member towards a seat in a position in which the internal circuit of the second valve is closed, the shut-off member being subjected to the force of the pressurized fluid in the said internal circuit coming from the upstream end and which is exerted against the action of the force of the return member,
- the internal circuit of the second valve comprises a second downstream end opening onto the body of the second valve and comprising a purge valve that can be actuated mechanically in order to open the second downstream end of the circuit to the outside of the second valve in order to purge the said internal circuit,
- the mobile actuating member forms a valve driver intended to move the at least one shut-off member by mechanical actuation,
- the internal circuit of the first valve comprises two shut-off members positioned in series, and the actuating member is translationally mobile and configured to open the shut-off members in series by mechanical actuation of a first shut-off member such that the movement of this first shut-off member by reaction pushes against and moves the next shut-off member,
- the first and second valves comprise respective coupling elements forming a quick-connection system for removably connecting the second valve to the first valve,
- the mobile control member comprises a lever mounted in articulated fashion on the second valve or a knob that can be rotated and/or made to effect a translational movement,
- the mobile actuating member comprises a translationally mobile rod.

The invention may also relate to any alternative device or method comprising any combination of the above or following features within the scope of the claims.

BRIEF DESCRIPTION OF THE DRAWINGS

Further particular features and advantages will become apparent from reading the following description, given with reference to the figures, in which.

DESCRIPTION OF PREFERRED EMBODIMENTS

Figure 1:
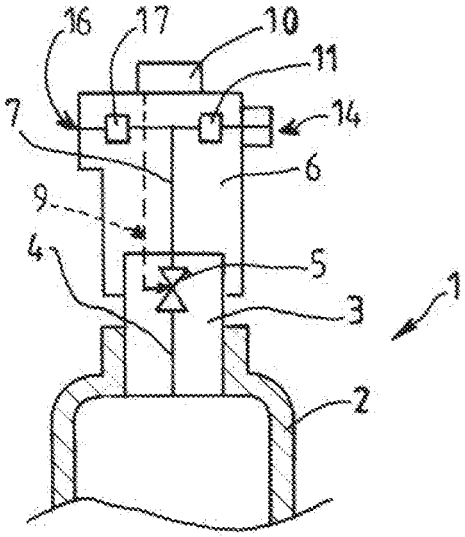
FIG. 1 is a schematic and partial view in cross section, illustrating one possible embodiment of the device for supplying fluid according to the invention.

The device 1 for supplying pressurized fluid illustrated in FIG. 1 comprises a reservoir 2 (for example a cylinder) for pressurized fluid equipped with an orifice in which a first valve 3 is fixed (for example screwed in).

The first valve 3 houses an internal fluid circuit 4 provided with at least one shut-off member 5. This internal circuit 4 comprises for example a first upstream end in communication with the storage volume of the reservoir 2 and a downstream end 13 opening for example onto one end of the body of the first valve 3.

The device 1 further comprises a second valve 6 mechanically and detachably (removably) connected to the first valve 3.

Figure 3:
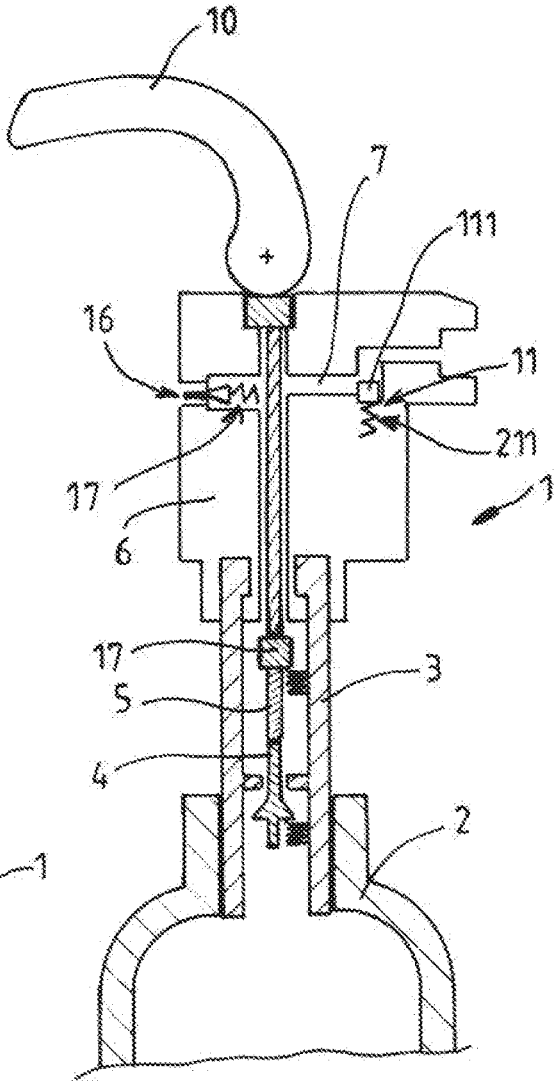
FIG. 3 is a schematic and partial view in cross section of another possible embodiment of the device for supplying fluid and in a state or configuration of use.
Figure 2:
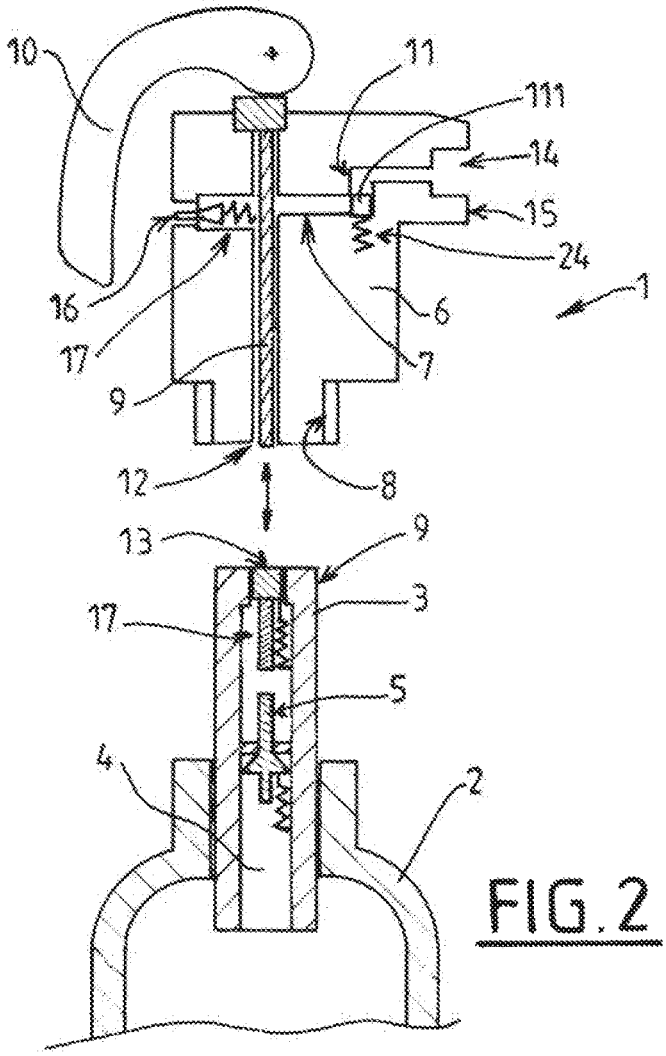
FIG. 2 is a schematic and partial view in cross section of another possible embodiment of the device for supplying fluid and in a state or configuration of use.

For example, the first valve 3 and the second valve 6 comprise respective coupling members 8, 9 forming a quick-connection system for detachably connecting the second valve 6 to the first valve (cf. FIGS. 2 and 3).

The second valve 6 also comprises an internal circuit 7 for transferring pressurized fluid. In the position in which the second valve 6 is connected to the first valve 3, the internal circuit 7 of the second valve 6 is fluidically connected to the internal circuit 4 of the first valve 3. For example, an upstream end 12 of the internal circuit 7 of the second valve 6 is connected to the downstream end 13 of the circuit 4 of the first valve 3.

The second valve 6 comprises a mobile actuating member 9 preferably forming a valve driver intended through mechanical actuation to open the at least one shut-off member 5 of the first valve 3. In addition, the second valve 6 comprises a mobile control member 10, preferably one which can be actuated by hand, intended to command the movement of the actuating member 9 in order to command the opening or non-opening of the shut-off member 5 of the first valve.

As illustrated in the figures, the mobile control member 10 may comprise or consist of at least one of the following: a lever mounted in articulated fashion on the second valve 6 (cf. FIGS. 2 and 3), a knob or hand-wheel that can be turned and/or made to effect a translational movement (cf. FIG. 1) on the body of the valve 6.

The device 1 further comprises a residual-pressure valve 11 configured to prevent the reservoir 2 from being fully emptied below a determined pressure threshold (for example comprised between 1.5 and 10 bar, notably between 2 and 10 bar).

According to one advantageous particular feature, the residual-pressure valve 11 is situated in the second valve 6. What that means to say is that the function of maintaining the residual pressure is performed only by the second valve 6 which connects to the first valve 3. That makes it possible to simplify the design of the first valve 3 without detracting from the protection of the contents of the reservoir 2.

For example, the internal circuit 7 of the second valve 6 comprises an upstream end 12 intended to be connected to the downstream end 13 of the internal circuit 4 of the first valve 3 and a first downstream end 14 opening onto an outlet coupling 15. The outlet coupling 15 is, for example, intended to be fluidically connected to a receiver of the gas withdrawn from the reservoir 2.

The residual-pressure valve 11 is situated in the internal circuit 7 of the second valve 6 between the upstream end 12 and the downstream end 13, preferably near the outlet coupling 15.

As visible in FIGS. 2 and 3, the residual-pressure valve 11 comprises for example a mobile shut-off member 111 (for example a piston) urged by a return member 211 (for example a spring) towards a seat in a position in which the internal circuit 7 of the second valve 6 is closed. This shut-off member 211 is subjected to the force of the pressurized fluid in the said internal circuit 7 coming from the upstream end 12. This pressure force tends to oppose the force of the return member 211. Thus, depending on the sizing of the residual-pressure valve 11, this valve prevents (shut-off member closed under the action of the spring 211) fluid from leaving when the pressure upstream is below a determined threshold.

The residual-pressure valve 11 may also incorporate a non-return function ("NRV"="Non Return Valve") preventing gas from flowing between the downstream end 14 and the upstream end 12 (thus preventing unwanted filling).

As illustrated in the figures, the internal circuit 7 of the second valve 6 may comprise a separate second downstream end 16 opening onto the body of the second valve 6. The two downstream ends 16, 14 may be connected in parallel to the upstream end 12 of the internal circuit 7.

This second downstream end 16 may be equipped with a purge valve 17 that can be actuated, preferably mechanically (for example by hand), in order to open the second downstream end 16 of the circuit to the outside of the second valve 6 in order to purge the said internal circuit 7. This then allows the internal circuit 7 of the second valve for example to be depressurized before the second valve 6 is detached from the first valve 3.

Of course, the invention is not restricted to the exemplary embodiment described hereinabove.

Thus, as depicted in FIGS. 2 and 3, the internal circuit 4 of the first valve 3 may comprise two shut-off members 5, 17 positioned in series.

In the closed position, a first 17 of the shut-off members may lie flush with one end of the first valve 3.

The actuating member 9 may be translationally mobile to form a valve driver configured to open the shut-off members 17, 5 in series by mechanical actuation of a first shut-off member 17 so that the movement of this first shut-off member 17 (movement inside the body of the first valve 3) pushes on or allows the movement of the next shut-off member 5 (cf. FIGS. 2 and 3 and document WO2012004481A1, for example).

Likewise, the first valve 3 could comprise three shut-off members in series (or more and/or other components). For the sequence for opening three shut-off members in series, reference may for example be made to the example in document WO2016139404A1.

Thus, when the second valve 6 (which provides for the opening of the shut-off member(s) 17, 5) is detached from the first valve 3, the shut-off member(s) 17, 5 automatically (under the action of return member(s) such as springs) re-close the internal circuit 4 of the first valve 3. Thus, contamination or full emptying of the reservoir 2 is avoided. When the second valve 6 is connected to the first valve 3 and opens the internal circuit 4 of the first valve (via the movement of the shut-off member(s) 17, 5), full emptying or contamination of the reservoir 2 is impossible even if the user forgets to move the control member 10 into the position for closing the internal circuit 4.

As illustrated schematically in FIGS. 2 and 3, the shut-off member(s) 17, 5 may comprise a mobile element (piston) urged towards a seat by a return member (for example a spring).

In the example of FIGS. 2 and 3, the mobile actuating member 9 comprises a translationally mobile rod. Of course, this could be replaced by any other suitable system.

Likewise, the invention has been described with just one reservoir 2 but could apply to a collection of reservoirs (a rack of cylinders for example) connected to the first valve 3. In addition, the second valve may comprise an adjustable or non-adjustable pressure regulator to reduce the pressure of the gas to a determined level. For example, the regulator is situated in the internal circuit 7 or at the outlet coupling 15.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. A device for supplying pressurized fluid, comprising:

at least one pressurized fluid reservoir comprising an orifice connected to a first valve, the first valve housing an internal fluid circuit fitted with at least one shut-off member, a second valve mechanically and detachably connected to the first valve, the second valve comprising an internal circuit for the transfer of pressurized fluid when the second valve is in the position to be coupled to the first valve, and a residual-pressure valve configured to prevent the at least one pressurized fluid reservoir from emptying fully below a determined pressure threshold when the at least one shut-off member is open, wherein the residual-pressure valve is situated in the second valve, the internal circuit of the second valve being fluidically connected to the internal circuit of the first valve, the second valve comprising a mobile actuating member configured to open the at least one shut-off member of the first valve, the second valve further comprising a control member that is mobile and configured to command the movement of the actuating member and command the opening or non-opening of the shut-off member of the first valve.

2. The device of claim 1, wherein the internal fluid transfer circuit of the second valve comprises an upstream end configured to be connected to a downstream end of the internal circuit of the first valve and at least a first downstream end opening onto an outlet coupling, the outlet coupling configured to be fluidically connected to a receiver of the gas withdrawn from the reservoir, and wherein the residual-pressure valve is situated in the internal fluid transfer circuit of the second valve between the upstream end and the downstream end.

3. The device of claim 2, wherein the residual-pressure valve comprises a mobile shut-off member urged by a return member towards a seat in a position in which the internal circuit of the second valve is closed, the shut-off member being subjected to the force of the pressurized fluid in the said internal circuit coming from the upstream end and which is exerted against the action of the force of the return member.

4. The device of claim 2, wherein the internal circuit of the second valve comprises a second downstream end opening onto the body of the second valve and comprising a purge valve that is actuated mechanically in order to open the second downstream end of the circuit to the outside of the second valve in order to purge the said internal circuit.

5. The device of claim 1, wherein the mobile actuating member forms a valve driver intended to move the at least one shut-off member by mechanical actuation.

6. The device of claim 1, wherein the internal circuit of the first valve comprises two shut-off members positioned in series, and in that the actuating member is translationally mobile and configured to open the shut-off members in series by mechanical actuation of a first shut-off member such that the movement of the first shut-off member by reaction pushes against and moves the next shut-off member.

7. The device of claim 1, wherein the first and second valves comprise respective coupling elements forming a quick-connection system for removably connecting the second valve to the first valve.

8. The device of claim 1, wherein the mobile control member comprises a lever mounted in articulated fashion on the second valve or a knob that can be rotated and/or made to effect a translational movement.

9. The device of claim 1, wherein the mobile actuating member comprises a translationally mobile rod.

* * * * *